US005961344A

United States Patent [19]

Rosales et al.

[11] Patent Number: 5,961,344

[45] Date of Patent: Oct. 5, 1999

[54] CAM-ACTUATED TERMINAL CONNECTOR

[75] Inventors: Mark Steven Rosales, Southfield; William Gronowicz, Westland, both of Mich.

[73] Assignee: Yazaki Corporation, Tokyo, Japan

[21] Appl. No.: 08/920,016

[22] Filed: Aug. 26, 1997

[51] Int. Cl.[6] ..... H01R 9/07

[52] U.S. Cl. ..... 439/495

[58] Field of Search ..... 439/495, 863, 439/864, 876

[56] References Cited

U.S. PATENT DOCUMENTS

| | | | |
|---|---|---|---|
| 3,070,771 | 12/1962 | Piorunneck | 439/495 |
| 3,576,518 | 4/1971 | Bazille . | |
| 3,579,283 | 5/1971 | Welburn | 439/495 |
| 3,824,529 | 7/1974 | Dorrell . | |
| 4,743,080 | 5/1988 | Siraty . | |
| 5,470,238 | 11/1995 | Walden | 439/98 |
| 5,735,709 | 4/1998 | Hashiguchi et al. | 439/495 |

*Primary Examiner*—Khiem Nguyen
*Attorney, Agent, or Firm*—Young & Basile, P.C.

[57] ABSTRACT

A connector for removably joining a plurality of electrical terminals to a flat cable. The connector has a housing containing two eccentric cams mounted on separate, parallel axes. The cams are spring biased to a closed position wherein the adjacent surfaces are relatively close together and are rotatable by a push-button actuated release mechanism to an open position wherein the surfaces are relatively far apart. An end of the flat cable is stripped of insulation to expose the conductors and is inserted through an aperture in the housing and between the adjacent surfaces of the cams from a first direction. The plurality of terminals is inserted through a second aperture and between the adjacent surfaces of the cams from the opposite direction into overlapping relationship with the flat cable. A ridge projecting from the surface of the first cam engages a trough formed in the surface of the second cam when the cams are in the closed position to clamp the terminals into contact with the respective conductors of the cable. Any tension on the cable tends to rotate the cams to clamp even more tightly on the cable and terminals so that it is very difficult to pull the cable out of the connector. The terminals and/or cable are easily removed from the connector by depressing the push-button release mechanism.

19 Claims, 3 Drawing Sheets

10
11
11a
11b
12
12a
12b
13
13a
13b
13c
14
16
18
20
22
24
24a
25
26
28
29
30
34
42
42a
42b
46
52
54
58b
58c
60a
60b
62
64
2

CAM-ACTUATED TERMINAL CONNECTOR

FIELD OF THE INVENTION

This invention relates in general to connectors for joining a terminal to an electrical conductor, and more specifically to a connector employing two rotatable cams to temporarily and reversibly clamp terminals into contact with the conductors of a flat cable.

BACKGROUND OF THE INVENTION

It is often desirable to connect terminals to the end of a length of flat cable in order that the cable may be temporarily and reversibly joined to another length of cable or some other electrical component. Commonly, a terminal housing is provided which fits over the end of the cable and contains a plurality of metal terminals, one for each of the conductors of the flat cable. The terminals are formed to include sharp contacts which pierce the insulation covering the flat cable and bite into the conductors enclosed therein when the housing is clamped onto or otherwise fastened to the end of the flat cable. This type of connection generally causes damage to the conductors and the insulation of the flat cable. If it becomes necessary to remove and replace one or more of the terminals, for example due to some defect in a terminal, the damage done to the end of the cable may make it impossible to attach a replacement terminal in a manner which provides a reliable connection.

Another known type of terminal connector is intended for use with a flat cable after the insulation has been stripped from the cable at the end thereof to expose the conductors. The stripped end of the cable is inserted into the terminal housing and a movable portion of the housing is squeezed shut to urge the conductors into planar contact with flat surfaces of terminals within the housing. Such connectors do not damage the conductors of the flat cable, but are usually prone to being inadvertently pulled off of the end of the cable, since the planar contact between the smooth surfaces of the conductors and the terminals does not provide sufficient friction to resist even a moderate degree of tension on the cable.

SUMMARY OF THE INVENTION

It is an object of this invention to provide a reliable, direct electrical connection between a flat cable and a plurality of electrical terminals.

Another object of the invention is to provide a terminal connector which allows a quick and simple release of the flat cable from the terminals without any disassembly of the connector.

A further object of the invention is to provide a terminal connector which securely attaches the electrical terminals to the flat cable while allowing the terminals to be removed from the connector for servicing or replacement.

In the preferred embodiment of the invention described and depicted herein, a housing contains two eccentric cams mounted on separate, parallel axes. The cams are rotatable between an open position wherein adjacent surfaces thereof are relatively far apart and a closed position wherein the adjacent surfaces are relatively close together. Springs bias the cams toward the closed position. A ridge projects from the surface of the first cam and a trough is formed in a corresponding position on the surface of the second cam such that the ridge is proximate to and aligned with the trough when the cams are in the closed position.

A first aperture formed in the housing allows the end of a flat cable to be inserted therethrough such that bare conductors of the flat cable are positioned between the adjacent surfaces of the cams. A second aperture on the opposite end of the housing allows a plurality of terminals to be inserted therethrough and between the adjacent surfaces of the cams from the opposite direction. The conductors of the cable and the terminals are thus in overlapping relationship with one another.

When the flat cable and the terminals are between the cams and the cams are urged toward the closed position by the springs, a brief tug on the cable causes the cams to rotate fully to the closed position so that the ridge and trough come into engagement with one another and clamp the terminals firmly into contact with the cable conductors to ensure good electrical connection. Any further tension on the cable tends to rotate the cams to clamp even more tightly on the cable and terminals so that it is very difficult to pull the cable out of the connector.

A push-button actuated release mechanism allows the cams to be rotated against the spring bias to the open position to allow insertion and withdrawal of the flat cable and terminals from between the cams.

DETAILED DESCRIPTION OF THE PREFERRED EMBODIMENT

Figure 1:
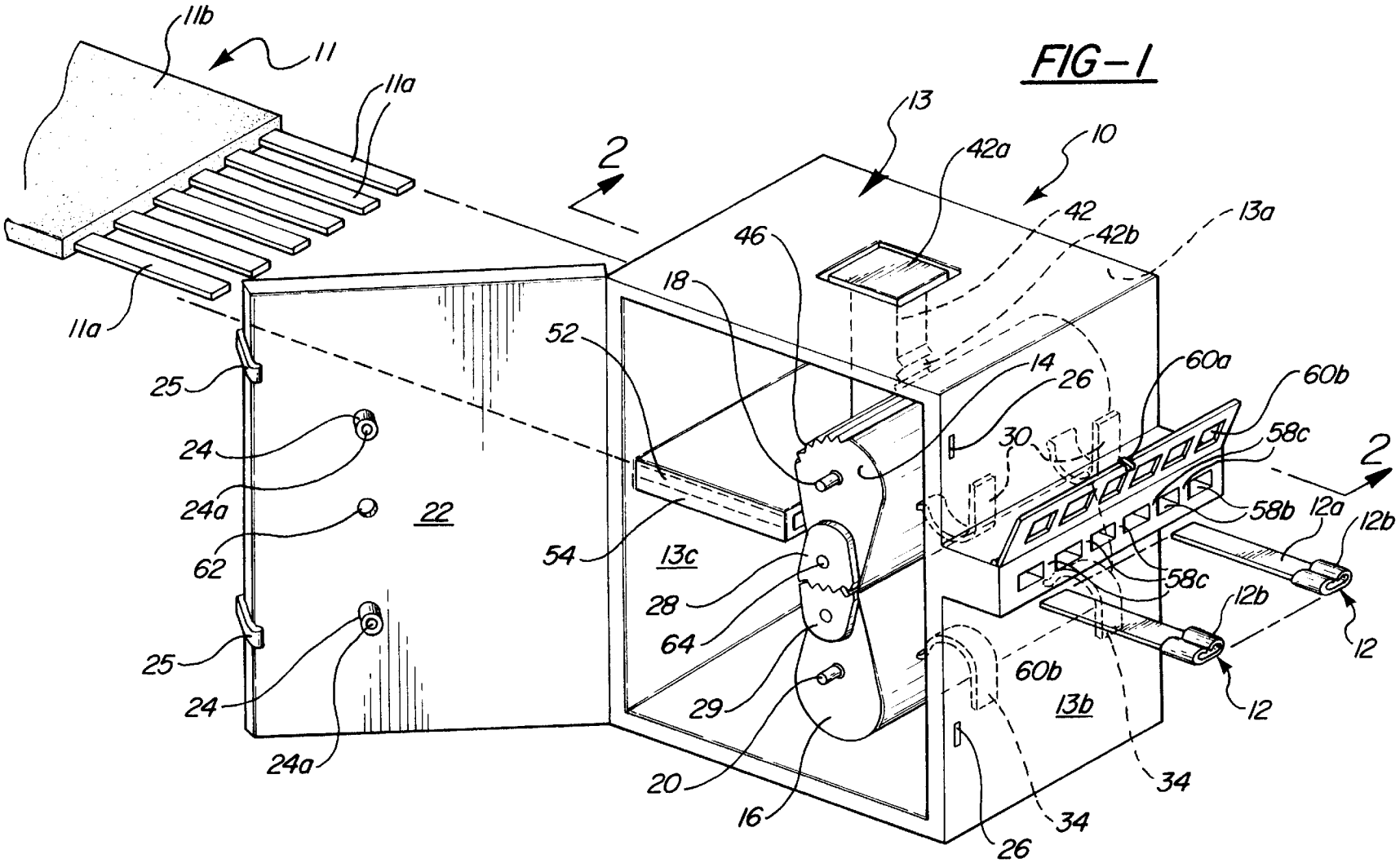
FIG. 1 is a perspective view of a terminal connector according to the present invention along with a flat cable and electrical terminals prior to their insertion into the connector.

Referring to FIGS. 1–4, a connector 10 according to the present invention is adapted to provide electrical continuity between a multi-conductor flat cable 11 and a plurality of terminals 12. Connector 10 comprises a generally rectangular housing 13 having an upper cam 14 and a lower cam 16 mounted therein for rotation about upper and lower shafts 18,20 respectively. Shafts 18,20 are fixed to a side wall 13*a* of the housing at their first ends and extend in cantilever fashion therefrom, such that second ends of the shafts are adjacent an open side of the housing which is fitted with a hinged door 22. Shaft end supports 24 are fixed to the inner surface of door 22 in positions such that the ends of shafts 18,20 fit into holes 24*a* in the end supports when the door is closed. Latch tabs 25 extend from door 22 for engagement with latch receptacles 26 disposed on housing 13 when the door is closed.

Figure 2:
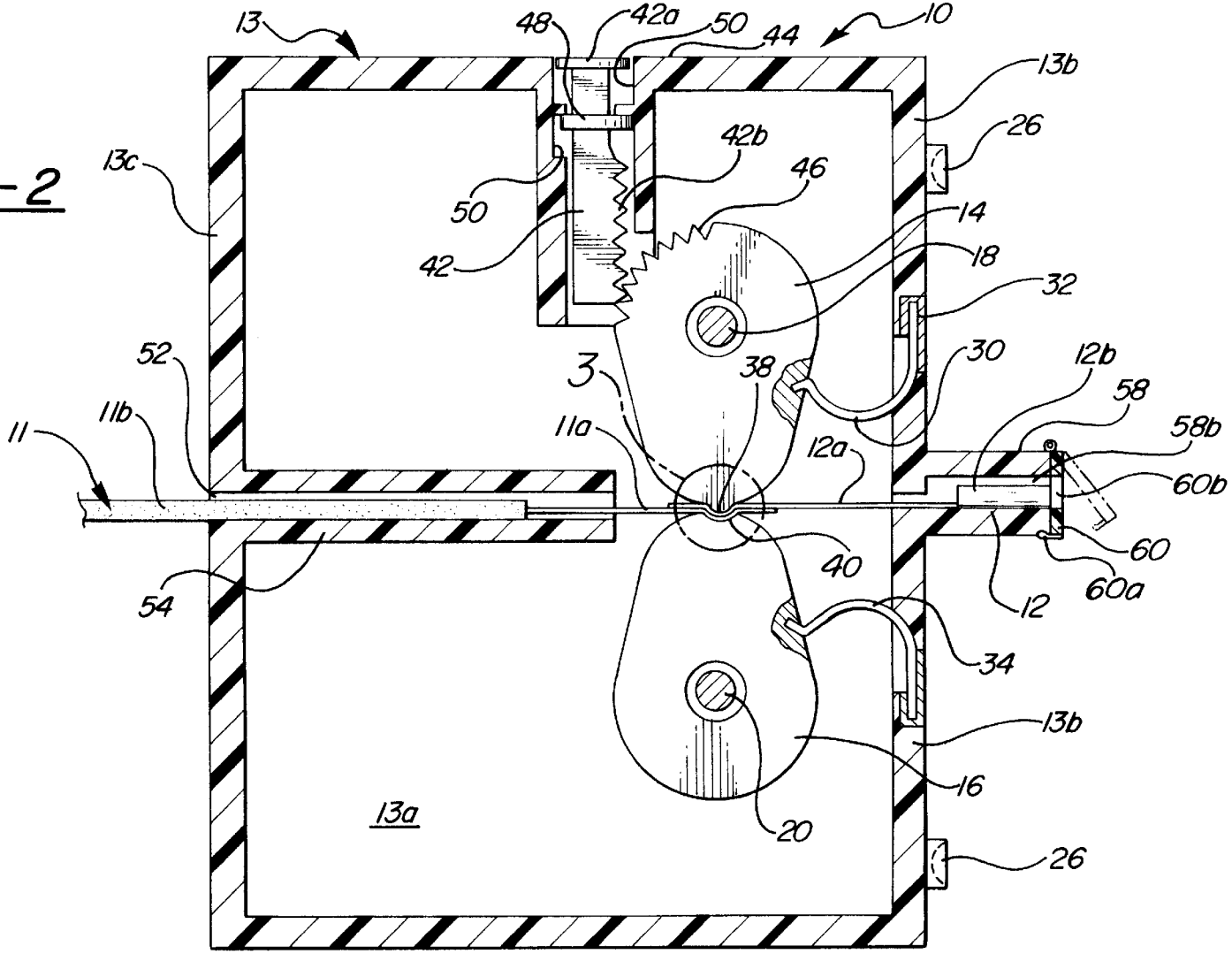
FIG. 2 is a cross-sectional view of the invention electrical connector taken along lines 2—2 of FIG. 1, with the flat cable and terminals inserted therein.
Figure 4:
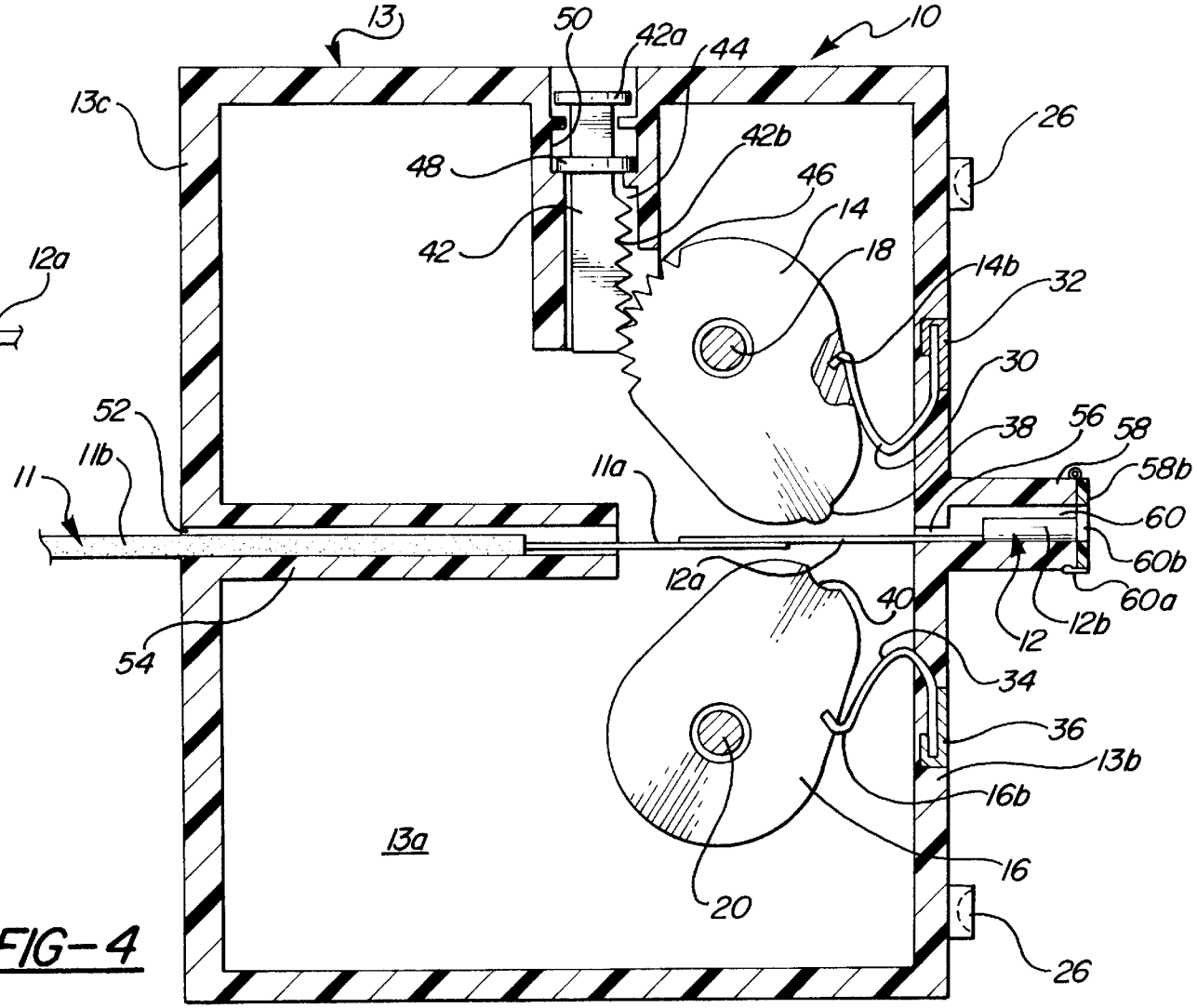
FIG. 4 is a cross-sectional view with the cams rotated to the open position to allow insertion and withdrawal of the cable and terminals.

Upper and lower cams 14, 16 are oblong in profile and are sized such that their surfaces are in close proximity to one another when their points of maximum radius are aligned with one another (see FIG. 2). Gear segments 28,29 are attached to the ends of upper and lower cams 14,16 respectively and mesh with one another to ensure that the cams rotate in unison and in opposite directions. Upper flat springs 30 have first ends retained within pockets 32 (see FIGS. 2 and 4) formed in a first housing end wall 13*b* of housing 13 and second ends retained in slots 14*b* formed in the upper cam. Lower flat springs 34 have first ends retained within pockets 36 formed in end wall 13*b* and second ends retained in slots 16*b* formed in the lower cam. Upper flat springs 30 urge upper cam 14 in the clockwise direction toward the position shown in FIG. 2, and lower flat springs 34 urge lower cam 16 counterclockwise toward the position shown in FIG. 2.

A ridge 38 projects from the surface of upper cam 14 and extends along a line at its point of maximum radius. A correspondingly shaped trough 40 extends along the surface of lower cam 16 coincident with its point of maximum radius.

A cam actuation member 42 is mounted for reciprocal motion in a channel 44 extending downwardly into housing 13 from an upper surface thereof. Cam actuation member 42 has an upper end in the form of a push-button 42*a*, and a toothed rack 42*b* formed along one side thereof. Rack 42*b* is in meshing engagement with gear teeth 46 formed on a portion of the circumference of upper cam 14. A thin metal retaining clip 48 snaps into a groove in cam actuation member 42 and projects therefrom to engage a notch 50 formed in the side of the channel so as to limit both upward and downward travel of the cam actuation member.

A horizontal, slit-like cable aperture 52 is formed in a second end wall 13*c* of the housing and a guide channel 54 extends therefrom into the housing to a point close to cams 14,16. A terminal aperture 56 is formed in first end wall 13*b* of the housing, and a terminal receptacle 58 projects from the exterior of housing end wall 13*b* and encloses the terminal aperture. The interior of terminal receptacle 58 is subdivided into a plurality of terminal channels 58*b* by walls 58*c*. A cover 60 is fitted to the end of terminal receptacle 58 and is hinged to move between open and closed positions. Cover 60 has a plurality of windows 60*b* formed therein which are aligned with the respective terminal channels 58*b*. A latch tab 60*a* extends from cover 60 for engagement with a groove in the underside of terminal receptacle 58 to hold the cover in the closed position.

Figure 3:
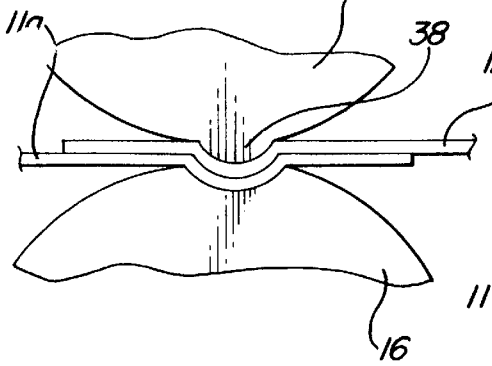
FIG. 3 is a detail of the two cams at the spot indicated in FIG. 2.

Flat springs 30, 34 exert force on their respective cams 14,16 tending to rotate the cams toward the closed position seen in FIG. 2. The engagement between rack 42*b* of cam actuation member 42 and gear teeth 46 on upper cam 14 prevents the upper cam from rotating clockwise beyond the closed position, and engagement between the gear segments 28,29 prevents lower cam 16 from rotating counterclockwise beyond the closed position. In the closed position, ridge 38 on upper cam 14 and the trough 40 on lower cam 16 are in alignment and engaged with one another as seen in FIG. 3. When ridge 38 and trough 40 are in engagement, there is a small amount of clearance between the two components.

A spot 64 is painted or otherwise formed on the end of upper gear segment 28, and a viewing hole 62 is formed in door 22 at a position generally between the two shaft end supports 24. The spot 64 is of color to provide a visual contrast with color of the rest of the end of upper gear segment 28, and the hole 62 is located such that the spot is visible only when upper and lower cams 14, 16 are rotated to the closed position.

Terminals 12 each have a flat, electrically conductive blade 12*a* and a female end 12*b* for receiving a mating conductor (not shown). Terminals 12 are inserted into their operative position within connector 10 by opening cover 60 and sliding each terminal, blade end first, into one of channels 58*b* of the terminal receptacle.

As terminals 12 are slid into receptacle 58, upper and lower cams 14,16 are rotated to the open position (see FIG. 4) by pressing downward on cam actuation push-button 42*a*. When cams 14, 16 are in the open position there is sufficient clearance between the adjacent surfaces of the cams to permit the blades 12*a* of the terminals to pass therebetween. Once terminals 12 are completely within their respective terminal channels 58*b*, cover 60 is moved to the closed and latched position and cam actuation member 42 is released to allow upper and lower cams 14,16 to rotate back to the closed position under urging of flat springs 30,34. Cover 60 retains terminals 12 within their respective terminal channels 58*b*, and female terminal ends 12*b* are aligned with windows 60*b* so that other conductors (not shown) may be inserted through the windows and into electrical contact with the terminals.

Flat cable 11 has a plurality of flat conductors 11*a* disposed in a parallel, side-by-side arrangement and covered by insulation 11*b*. To prepare flat cable 11 for use with connector 10, the insulation is stripped from the end of the cable to expose approximately a one inch length of conductors 11*a*. The stripped end of flat cable 11 is then inserted into cable aperture 52 and pushed through guide channel 54 to reach the interface between cams 14,16. If the rotational force exerted on cams 14,16 by flat springs 30,34 is relatively weak, the urging of conductors 11*a* into contact with the cams may be sufficient to rotate the cams toward the open position by an amount sufficient for the conductors to slide between the cams. Otherwise, cam actuation member 42 is depressed to rotate the cams toward the open position and allow conductors 11*a* to slide therebetween.

As conductors 11*a* slide between the cams, the conductors pass either over or under respective terminal blades 12*a* in an overlapping fashion. Once flat cable 11 has been inserted between the cams and cam actuation member 42 is released, flat springs 30,34 urge the cams toward the closed position such that they squeeze conductors 11*a* and terminal blades 12*a* against one another. To complete the joining process, the portion of flat cable 11 extending from the connector is grasped and pulled gently outwardly from the housing. The friction between conductors 11*a* and the cam which they contact causes the cams to be rotated more fully and firmly to the closed position. Ridge 38 and trough 40 fit into engagement with one another to clamp the conductors 11*a* and terminal blades 12*a* firmly into contact with one another (see FIG. 3), ensuring good electrical contact therebetween as well as gripping flat cable 11 tightly to secure it against being pulled out of the connector.

Spot 64 is visible through viewing hole 62 only if the cams 14, 16 are in the closed position, thus providing a visual indication of the condition of the connector 10 without opening door 22 to inspect the interior workings. Spot 64 is preferably green in color and the rest of the end of upper cam 14 is red, so that a user of the connector 10 is presented with a red "warning" indication if the connector is not in the fully closed position, and a green "safe", indication if the cams are properly closed.

To remove flat cable 11 and/or terminals 12 from connector 10, cam actuation member 42 is forced downward by depressing push-button 42*a*, thereby rotating cams 14,16 toward the open position. The grip of the cams on conductors 11*a* and terminal blades 12*a* is thereby released and the flat cable 11 is simply pulled from the housing. Terminals 12*a* are removed by unlatching and opening the cover 60 and pulling them out of receptacle 58. Both insertion and withdrawal of flat cable 11 and terminals 12 may be accomplished with door 22 in the closed position. Door 22 is provided to give access if it is necessary to clean or perform some other maintenance on the cam mechanism.

The clamping action of the cams ensures positive, reliable electrical connection between the conductors of a flat cable and the terminals, and also prevents the cable from being inadvertently pulled out of the connector. The invention connector does not cut, or otherwise damage the flat cable nor the terminals. The actuation mechanism provides for quick and easy removal and replacement of both the flat cable and the terminals. The size of the connector may be tailored to accept a flat cable of any width and any number of terminals.

Whereas a preferred embodiment of the invention has been illustrated and described in detail, it will be apparent that various changes may be made in the disclosed embodiment without departing from the scope or spirit of the invention.

The invention claimed is:

1. A connector for achieving electrical continuity between a flat cable having at least one conductor and at least one mating conductor, the connector comprising:

a housing having a first aperture for receiving the flat cable therethrough and a second aperture for receiving the mating conductor therethrough;

first and second cams mounted within the housing for rotation about parallel, spaced axes between respective first positions wherein confronting surfaces of the cams are spaced from one another by a first distance sufficiently large to receive the flat cable and the mating conductor therebetween in overlapping relationship to one another, and respective second positions wherein the confronting surfaces are spaced from one another by a second distance sufficiently small to clamp the overlapping flat cable conductor and the mating conductor into contact with one another;

means for biasing the cams toward the second positions; and means on the cams for ensuring that the cams rotate in unison with one another and in opposite directions about their respective axes.

2. A connector according to claim 1 wherein the second aperture comprises means for restraining the mating conductor against being withdrawn from the housing through the second aperture.

3. A connector according to claim 2 wherein the means for restraining the mating conductor comprises a receptacle for receiving the mating conductor and a cover openable to allow insertion of the mating conductor into the receptacle and between the confronting surfaces of the cams and closable to inhibit removal of the mating conductor from the receptacle.

4. A connector according to claim 3 wherein the cover has at least one window formed therein for receiving a third conductor therethrough into connection with the mating conductor.

5. A connector according to claim 1 further comprising means actuable from outside of the housing to rotate at least one of the cams toward the first position.

6. A connector according to claim 5 wherein the means for rotating the at least one cam comprises a series of gear teeth on the at least one cam and a member movable with respect to the housing and having a toothed rack engageable with the gear teeth on the at least one cam to rotate the cam.

7. A connector according to claim 1 wherein at least one of the confronting surfaces of the cams has means thereon for clamping the overlapping conductors into contact with one another.

8. A connector according to claim 7 wherein the clamping means comprises a projection on the first cam and a receptacle on the second cam, the projection and the receptacle fitting into engagement with one another when the cams are in their respective second positions.

9. A connector according to claim 1 wherein the means for biasing the cams comprises a first spring acting between the first cam and the housing and a second spring acting between the second cam and the housing.

10. A connector for achieving electrical continuity between a flat cable having at least one conductor and at least one electrical terminal having a blade portion and a coupling portion, the connector comprising:

a housing having a first aperture for receiving the flat cable therethrough and a second aperture for receiving the at least one terminal therethrough;

first and second cams mounted within the housing for rotation about parallel, spaced axes between respective first positions wherein confronting surfaces of the cams are spaced from one another by a first distance sufficiently large to receive the conductor and the terminal blade portion therebetween in overlapping relationship to one another, and respective second positions wherein the confronting surfaces are spaced from one another by a second distance sufficiently small to clamp the overlapping conductor into contact with the terminal blade portion;

means for biasing the cams toward the second positions; and means mounted in the housing and actuated from outside the housing for rotating at least one of the cams toward the first position.

11. A connector according to claim 10 wherein the second aperture comprises means for restraining the terminal against being withdrawn from the housing through the second aperture.

12. A connector according to claim 11 wherein the means for restraining the terminal comprises a cover openable to allow insertion of the terminal through the second aperture and between the confronting surfaces of the cams and closable to inhibit removal of the terminal from between the cams.

13. A connector according to claim 12 wherein the cover has at least one window formed therein for receiving a third conductor therethrough into connection with the terminal coupling portion.

14. A connector according to claim 10 wherein the means for rotating the at least one cam comprises a series of gear teeth on the at least one cam and a member movable with respect to the housing and having a toothed rack engageable with the gear teeth on the at least one cam to rotate the cam.

15. A connector according to claim 10 wherein at least one of the confronting surfaces of the cams has means thereon for clamping the overlapping conductor and terminal portion into contact with one another.

16. A connector according to claim 15 wherein the clamping means comprises a projection on the first cam and a receptacle on the second cam, the projection and the receptacle fitting into engagement with one another when the cams are in their respective second positions.

17. A connector according to claim 10 wherein the means for biasing the cams comprises a first spring acting between the first cam and the housing and a second spring acting between the second cam and the housing.

18. A connector according to claim 1 wherein the means for ensuring that the cams rotate in unison and in opposite directions comprises first and second gear segments disposed on the first and second cams respectively, the first and second gear segments meshingly engaged with one another.

19. A connector for achieving electrical continuity between a flat cable having at least one conductor and at least one mating conductor, the connector comprising:

a housing having a first aperture for receiving the flat cable therethrough and a second aperture for receiving the mating conductor therethrough;

first and second cams mounted within the housing for rotation about parallel, spaced axes, the cams having confronting surfaces, the confronting surfaces of the first cam having a projection and the confronting surface of the second cam having a receptacle, the cams being rotatable between respective first positions wherein the confronting surfaces of the cams are spaced from one another by a first distance sufficiently large to receive the flat cable and the mating conductor therebetween in overlapping relationship to one another, and respective second positions wherein the confronting surfaces are spaced from one another by a second distance sufficiently small to clamp the overlapping flat cable and the mating conductor into contact with one another between the projection and the receptacle.

* * * * *